US005675103A

United States Patent [19]

Herr

[11] Patent Number: 5,675,103

[45] Date of Patent: Oct. 7, 1997

[54] NON-LETHAL TETANIZING WEAPON

[76] Inventor: Jan Eric Herr, P.O. Box 15044, San Diego, Calif. 92175

[21] Appl. No.: 597,395

[22] Filed: Feb. 8, 1996

[51] Int. Cl.[6] ..... H01T 23/00

[52] U.S. Cl. ..... 89/1.11; 361/213; 361/232

[58] Field of Search ..... 89/1.11; 42/1.08; 361/117, 213, 232; 307/149

[56] References Cited

U.S. PATENT DOCUMENTS

| | | | |
|---|---|---|---|
| 3,719,829 | 3/1973 | Vaill | 307/149 |
| 3,775,638 | 11/1973 | Tidman | 315/36 |
| 3,803,463 | 4/1974 | Cover | 317/262 |
| 3,971,292 | 7/1976 | Paniagua | 89/1 A |
| 4,017,767 | 4/1977 | Ball | 361/117 |
| 4,453,196 | 6/1984 | Herr | 361/232 |
| 4,486,807 | 12/1984 | Yanez | 361/232 |
| 4,846,044 | 7/1989 | Lahr | 89/1.11 |
| 4,852,454 | 8/1989 | Batchelder | 89/1.11 |
| 4,930,392 | 6/1990 | Wilson | 89/1.11 |
| 5,103,366 | 4/1992 | Battochi | 361/232 |
| 5,175,664 | 12/1992 | Diels | 361/213 |

FOREIGN PATENT DOCUMENTS

| | | |
|---|---|---|
| 0326268 | 1/1989 | European Pat. Off. . |
| 0326269 | 1/1989 | European Pat. Off. . |

OTHER PUBLICATIONS

Channeling of an Ionizing Electrical Streamer by a Laser Beam, Koopman and Wilkerson, Oct. 1971, *Journal of Applied Physics*, pp. 1883–1886.

Formation and Guiding of High–Velocity Electrical Streamers by Laser–Induced Ionization, Koopman and Saum, Dec. 1973, *Journal of Applied Physics*, pp. 5328–5336.

Electric Shock Effects of Frequency, Kouwenhoven et al., Apr. 1936.

Effect of Electric Shock on the Heart, Ferris et al., May 1936.

Effect of Waveform on Let–Go Currents, Dalziel, Dec. 1943.

Effect of Frequency on Let–G0 Currents, Dalziel, Ogden, & Abbott, Dec. 1943.

Stimulation with Minimum Power, Offner, May 1946, *Journal of Neurophysiology*, pp. 387–390.

Lethal Electric Currents, Dalziel and Lee, Feb. 1969, *IEEE Spectrum*, pp. 44–50.

*Primary Examiner*—Michael J. Carone
*Assistant Examiner*—Christopher K. Montgomery
*Attorney, Agent, or Firm*—Henri J. A. Charmasson; John D. Buchaca

[57] ABSTRACT

A non-lethal weapon for temporarily immobilizing a target subject by means of muscular tetanization in which the tetanization is produced by conducting a precisely-modulated electrical current through the target. Because the electrical current is a close replication of the physiological neuroelectric impulses which control striated muscle tissue, it tetanizes the subject's skeletal muscles without causing any perceptible sensation. The transmission of this current to the distant target is via two channels of electrically conductive air. The conductive channels are created by multi-photon and collisional ionization within the paths of two beams of coherent (laser) or columnated incoherent ultra-violet radiation directed to the target. A single beam may be used to tetanize a grounded target. The high-voltage tetanizing current flows from electrodes at the origin of the beams along the channels of free electrons within them.

14 Claims, 2 Drawing Sheets

NON-LETHAL TETANIZING WEAPON

FIELD OF THE INVENTION

This invention relates to weapons and more particularly to a type of non-disabling weapon which may be used by military personnel or law enforcement agents for the temporary immobilization of a target subject or subjects. The invention also relates to muscle tissue involuntary contraction by application of electric current identical to or closely approximating the physiological neuroelectric impulses which control muscle movements.

BACKGROUND OF THE INVENTION

To this date, the known non-lethal and sub-lethal electrical weapons that have been designed to render a target subject less than completely functional have relied on low-frequency, high-voltage currents to shock, stun, or disorient said target subject. An early example of such a device is disclosed in U.S. Pat. No. 3,803,463, Cover. This device is a handheld weapon from which two small projectiles are fired at the target subject. Each projectile is attached to a fine conductive wire so as to deliver an electrical current to stun said target subject. The principal drawback of this type of device is that only a single shot can be fired without reloading. The weapon is thus of little value if it must be used against multiple targets, if one or both projectiles misses the target, or if the target subject is able to dislodge one or both of the projectiles or their wires before the stunning current is activated. Further, the weapon is classified as a firearm because the projectiles are propelled by nitrocellulose powder charges, and it is therefore subject to all the legal restrictions applied to firearms.

To overcome these difficulties, several non-lethal weapons have been proposed which project two parallel streams of electrically conductive liquid at the target subject. These streams are maintained at different potentials so as to complete a circuit when they contact a target subject and thereby stun said target subject with a series of very low frequency electrical pulses of about 10,000 volts each. Such weapons are disclosed, for example, in U.S. Pat. No. 3,971,292, Paniagua; U.S. Pat. No. 4,486,807, Yanez; U.S. Pat. No. 4,846,044, Lahr; U.S. Pat. No. 4,852,454, Batchelder; U.S. Pat. No. 4,930,392, Wilson; and U.S. Pat. No. 5,103,366, Battochi. The main disadvantage of these weapons is that they can be fired only a few times without reloading. A second disadvantage is that, like the earlier projectile-and-wire device, all these weapons create painful muscle spasms in the target subject that may cause injury, and invite legal action against the users. A third disadvantage is that capillary instability causes the liquid streams to break up into droplets after a short distance. A fourth disadvantage is that gravity quickly pulls such liquid streams into a ballistic arc, thus making aiming difficult. A fifth disadvantage is that the ionic flow within liquid electrolytes provides only weak electrical conductivity. A sixth disadvantage is that the target subject may be wetted by the liquid streams so that the current is short-circuited and unable to stun the subject. A seventh disadvantage is that the electromechanical nature of these devices and the corrosive liquids they employ tend to shorten their useful life.

Tetanization is the stimulation of muscle tissue by a rapid series of electrical impulses of such frequency as to fuse individual muscle contractions into a single sustained contraction. Tetanization is a well-known phenomenon: see Offner, "Stimulation With Minimum Power," Journal of Neurophysiology, Vol. 9, pp. 387–390, 1946; Dalziel, "Effect of Wave Form on Let-go Currents," AIEE Transactions, Vol. 62, pp. 739–744, 1943; Dalziel and Lee, "Lethal Electrical Currents", IEEE Spectrum, Vol. 6, pp. 44–50, 1969; Dalziel, Ogden, and Abbott, "Effect of Frequency on Let-go Currents," AIEE Transactions, Vol. 62, pp. 445–450, 1943; Kouwenhoven, Hooker and Lotz, "Electrical Shock Effects of Frequency", Electrical Engineering, Vol. 55, pp. 384–386, 1936; and Ferris et al., "Effects of Electrical Shock on the Heart", Electrical Engineering, Vol. 55, pp. 498–515, 1936.

The present invention also results from prior experiences in the laser-induced ionization of air as described by Koopman and Wilkerson, "Channeling of Ionizing Electrical Streamer by a Laser Beam", Journal of Applied Physics, Vol. 42, pp. 1183–1186, 1971, and Koopman and Saum, "Formation and Guiding of High-Velocity Electrical Streamers by Laser-Induced Ionization", Journal of Applied Physics, Vol. 44, pp. 5328–5336, 1973. Prior applications of laser-induced ionization can be found in U.S. Pat. No. 3,719,829, Vaill and U.S. Pat. No. 3,775,638, Tidman which disclose methods of creating a conductive path in a gas, U.S. Pat. No. 4,017,767 Ball and U.S. Pat. No. 4,453,196 Herr which disclose the transmission of electricity via laser-ionized air channels, and U.S. Pat. No. 5,175,664 Diels et al. which discloses methods of creating conductive paths of ionized air by means of laser beams toward the goal of discharging storm clouds.

SUMMARY OF THE INVENTION

The principal object of the instant invention is to provide a non-lethal immobilizing weapon for use by military or law enforcement personnel.

A second object of this invention is to provide a non-lethal, immobilizing weapon which is inherently safe in its operation.

A third object of this invention is to provide a non-lethal weapon which is capable of temporarily immobilizing a target subject without causing pain, shock, disorientation, or loss of consciousness.

A fourth object of this invention is to provide a non-lethal weapon which is capable of temporarily immobilizing a target subject without his being aware of the cause.

A fifth object is to provide a non-lethal, immobilizing weapon whose range is substantially greater than prior related weapons that use wires or conductive liquid streams.

A sixth object is to provide a non-lethal, immobilizing weapon which can be fired from a remote location without requiring the physical impact of solid or liquid matter upon the target.

A seventh object is to provide a non-lethal, immobilizing weapon which can be directed continuously and swept across an indefinitely large number of target subjects.

An eighth object is to provide a non-lethal, immobilizing weapon which can rapidly be fired toward a specific location on a single target subject, or to a specific target subject among many because of the highly directional nature of its current-conducting means.

A ninth object is to provide a non-lethal, immobilizing weapon which has a significantly longer service life than prior related weapons.

These and other objects are achieved by transmitting relatively high frequency electrical impulses to the target by means of one or two electrically conductive channels of ionized air produced within one or two beams of intense ultraviolet radiation aimed at the target, and by placing a high-voltage field of the opposite polarity across the path of each beam.

The present invention functions by immobilizing the target person or animal at a distance. It performs this function by producing skeletal muscle tetanization in the target subject. Tetanization is the stimulation of muscle tissue by a series of electrical impulses of such frequency as to merge individual muscle contractions into a single sustained contraction. The immobilizing tetanization is maintained as long as the weapon continues to produce an electrical current within a major portion of the skeletal musculature of the subject, and for a brief time thereafter due to paralysis caused by the temporary inhibition of neuromuscular impulses. The optimum current and frequency required to create and maintain immobility while avoiding impairment of cardiac or respiratory activity are 25 milliamperes and 100 hertz, respectively. Currents in the range of 20 to 50 milliamperes and 5 to 2500 hertz may also be employed, with the higher frequencies requiring higher currents. A frequency of about 2 hertz may ultimately be used to produce painful spastic contractions. A minimum electrical potential of approximately 600 volts is required to overcome skin resistance without producing burns.

The most effective current waveform in producing tetanization is that which most closely duplicates the physiologically produced neural impulse. As Offner points out, this waveform is an exponentially rising pulse. The second most effective waveform is a square wave, whereas the least effective is a sine wave. Due to their rapid risetimes, square waves allow the greatest penetration through the clothing and skin of the target subject.

Further, the differences in the effectiveness of various waveforms constitute an inherent safety factor in the operation of the instant weapon. This safety factor is a result of the rapid absorption by biological tissue of the harmonic frequencies within complex waveforms such as square waves. A 20 to 50 milliampere current is thus able to stimulate only the target subject's skeletal muscles, and cannot penetrate to the autonomically-controlled internal muscles such as the heart.

A lethal variation of the present weapon could be implemented by increasing the current above approximately 250 milliamperes. A sine wave current having a density of about 5 milliamperes per square centimeter that flows through cardiac muscle for more than about two seconds may initiate ventricular fibrillation. The duration of the current needed to cause ventricular fibrillation is inversely proportional to the current density within the cardiac muscle.

The current carried by the ionized air channel is limited by the number of free electrons within the ultraviolet beam. A minimum 20 milliampere current required to induce skeletal muscular tetanization can be carried by a gaseous channel with a concentration of $10^8$ ions per cubic centimeter. This concentration is most efficiently achieved in air by ionizing molecular oxygen with coherent or columnated incoherent ultraviolet radiation having a wavelength of 193 nanometers. Shorter wavelengths may be employed as optical technology progresses.

At its normal operating intensity and a wavelength of 193 nanometers, the ultraviolet beam is safe to the skin because it cannot produce more than mild erythema akin to a sunburn unless it is directed at the same location for many minutes. Moreover, it is safe to the eyes because wavelengths near 193 nanometers cannot penetrate the cornea to reach internal ocular structures such as the lens and retina.

At this wavelength, molecular oxygen has a two-photon ionization cross section of $1\times10^{-34}$ $cm^4$/watt. Because of its low ionization threshold, the number of photons required for ionization, and its large proportion in the atmosphere, it is easily able to create sufficient electron density.

The most efficient source of 193-nanometer radiation presently available is the argon fluoride discharge-pumped excimer laser. A reasonable power density, pulse duration, and pulse repetition rate for this laser is 5 megawatts per square centimeter, 10 nanoseconds, and 200 pulses per second, respectively.

An argon fluoride laser with an aperture of 1 square centimeter has a power density (energy output) of 10 millijoules per pulse or 1 megawatt per square centimeter. Each pulse liberates $6.3\times10^6$ electrons, or $6.3\times10^{14}$ electrons per second in the air immediately outside the aperture. A power density of 50 millijoules per pulse or 5 megawatts per square centimeter liberates $1.6\times10^8$ electrons during each pulse, which is equivalent to $1.6\times10^{16}$ electrons per second.

A narrow beam of ultraviolet radiation may also be generated from the collimated emission of an ultraviolet lamp.

The electron density in the channel of ionized air is a function of the ratio between the electron production and loss rates. In both the two-body and three-body electron attachment processes, the delay time between the end of the laser pulse and the beginning of the high-voltage tetanizing pulse determines the number of available electrons. When the electron energy is only 0.1 electron volt, for example, the three-body attachment is rapid, and the steady-state electron density for a 193 nanometer, 5 megawatt per square centimeter beam falls to $8\times10^7$ per cubic centimeter.

The range of the present weapon is determined by the rate at which the laser beam is absorbed by the atmosphere. A 193-nanometer wavelength beam is attenuated in dry air at about $1\times10^{-4}$ per centimeter. It will thus propagate approximately 100 meters before its intensity is decreased to 1/e of its initial value. As a consequence, the $1.6\times10^8$ electron density at the aperture of an argon fluoride laser with a power density of 5 megawatts per square centimeter falls to $2.2\times10^7$ after 100 meters. Because the minimum electron density required to transmit a current is between $10^6$ and $10^8$ per cubic centimeter, the above ionized channel should conduct the tetanizing current at least 100 meters. The range of this weapon could be increased, however, by the use of a more efficient ultraviolet source.

Various techniques, including those suggested in U.S. Pat. No. 4,017,767 Ball and U.S. Pat. No. 5,175,664, Diels et al. which are incorporated herein by reference, may be used in order to enhance the multi-photon and collisional ionization along the laser beams. These techniques are well known to persons skilled in the electrical arts.

DESCRIPTION OF THE PREFERRED EMBODIMENT OF THE INVENTION

Figure 1:
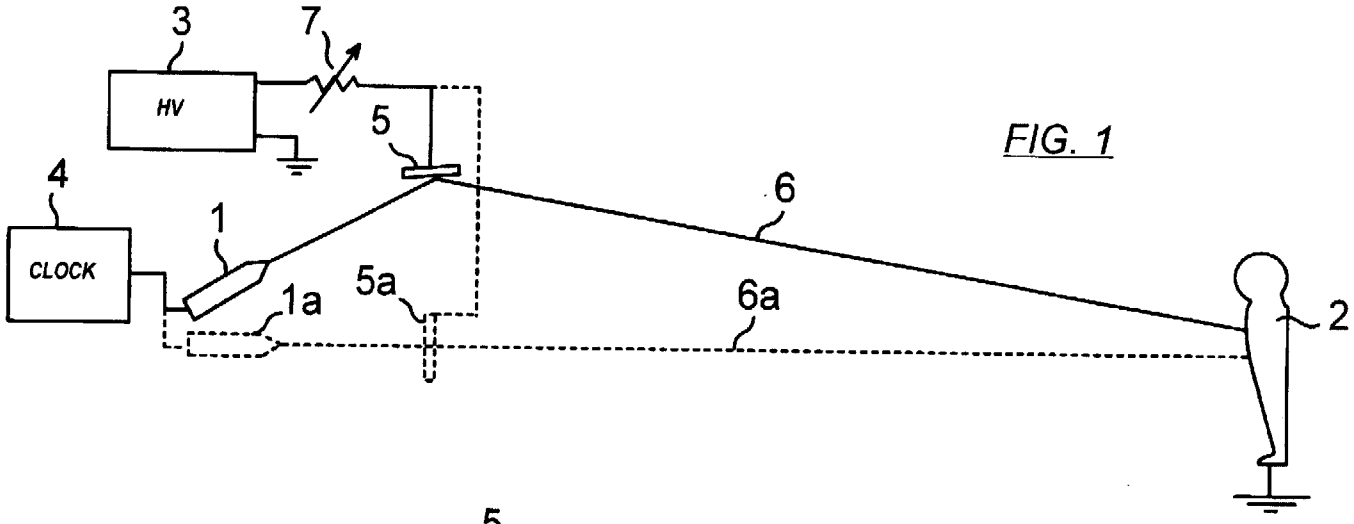
FIG. 1 is a diagrammatical illustration of a first embodiment of the invention.

Referring now to the drawings and more specifically to FIG. 1, there is illustrated a first embodiment of the invention. A high-intensity source of coherent or columnated incoherent ultraviolet radiation, typically operating in a pulsed mode such as a pulsed laser 1, directs a photon beam 6 having a wavelength of aproximately 193 nanometers toward a grounded human or animal target 2. A channel of ionized air is created within the photon beam 6 according to multi-photon, collisional, and other ionization processes. A high-voltage tetanizing pulse generator 3 has one of its output terminals connected to an electrically conductive mirror 5 or an electrically conductive transparent plate 5*a*, interposed in the path of the photon beam 6 or 6*a*. The second terminal of the high-voltage pulse generator 3 is connected to ground. A variable resistor 7 is mounted in series with one of the terminals of the high-voltage pulse generator 3 and controlled by a feedback circuit to maintain a constant current through the target 2. A clocking circuit 4 produces the synchronized triggering signals for both the pulsed laser 1 and the high-voltage pulse generator 3.

Assuming that a sufficient number of free electrons are created by the multi-photon, collisional, and other ionization processes between the mirror 5 or plate 5*a* and the target 2, an electrical path for the high-voltage pulses issuing from the generator 3 is provided to the body of the human or animal target 2.

Figure 2:
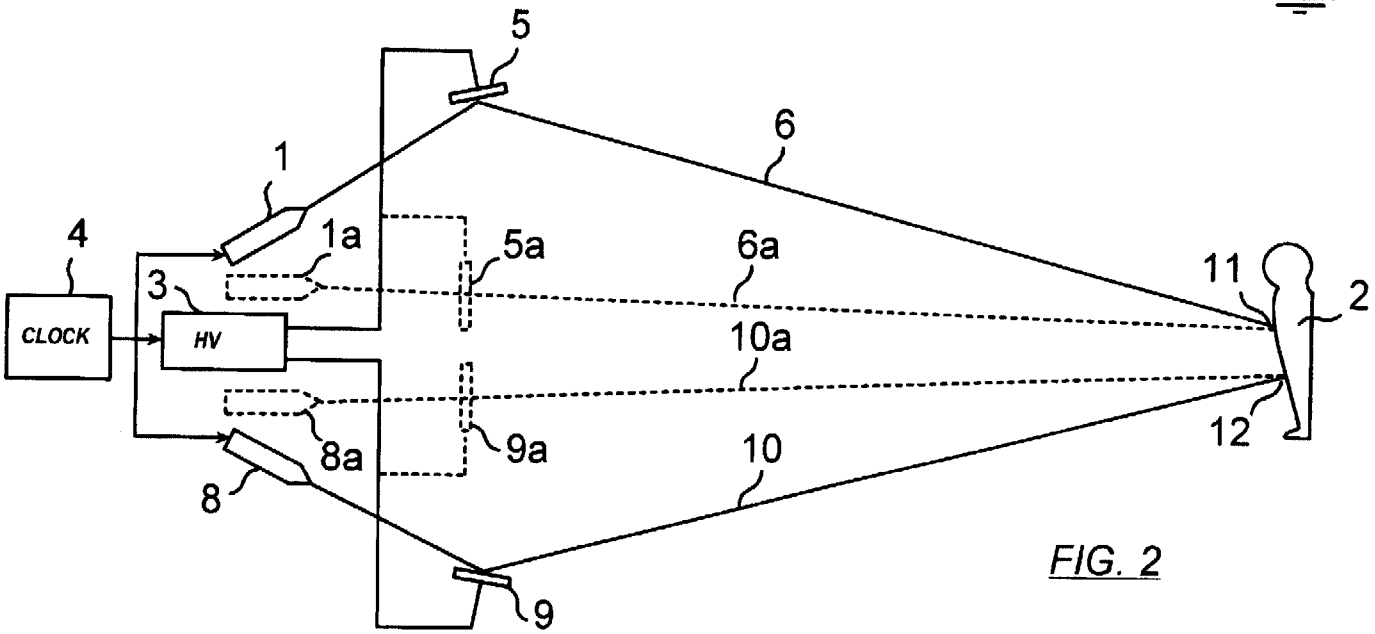
FIG. 2 is a diagrammatical illustration of a second embodiment of the invention.

In the second embodiment of the invention illustrated in FIG. 2, a second laser 8 is used to create the return path of the electrical circuit in place of the ground connection. The second terminal of the high-voltage pulse generator 3 is connected to a second electrically conductive mirror 9 or electrically conductive transparent plate 9*a* interposed in the path of the second laser beam 10. The laser beams 6 and 9 are directed to impinge upon the human or animal target 2 in two locations 11 and 12 between which the high-voltage tetanizing current is to flow. Assuming that sufficient free electrons are created in each of the ionized air channels between the mirror 5 or plate 5*a* and the location 11 on the target on one part, and the mirror 9 or plate 9*a* and the location 12 on the target on the other part, an electrical path for the high-voltage pulsed current is provided. This electrical path includes a portion of the target subject 2. The firing of the lasers 1 or 8 and the activation of the high-voltage pulse generator 3 are synchronized by means of the clocking circuit 4.

Figure 3:
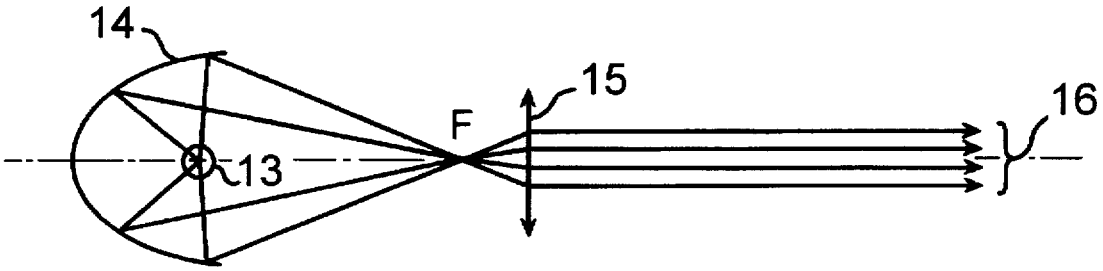
FIG. 3 is a diagrammatical illustration of an ultraviolet beam generating system using a UV lamp.

FIG. 3 is a diagrammatical illustration of a ultraviolet beam generating system wherein the radiation from a UV lamp 13 is focused by a parabolic reflector 14 on the focal center of a lens 15. The beam 16 of parallel ultraviolet rays is used to ionize an air channel.

While the preferred embodiments of the invention have been described, modifications can be made and other embodiments may be devised without departing from the spirit of the invention and the scope of the appended claims.

What is claimed is:

1. An apparatus for applying a tetanizing electrical current to muscular tissue of a distant human target which comprises:

means for generating a high-voltage pulsed electrical current modulated to closely replicate physiological neuroelectric impulses which control human striated, skeletal muscle tissue;

means for ionizing at least one channel of ambient air between said means for generating and the target; and means for inducing said tetanizing electrical current within said ionized channel wherein said means for generating and said means for ionizing have rated output powers capable of inducing a flow of pulsed electrical current through said tissue, said current being adjusted to cause tetanization of said tissue.

2. The apparatus claimed in claim 1, wherein said means for generating comprise:

a high-voltage pulse-creating electronic circuit;

said means for ionizing comprise means for emitting a first beam of ultraviolet radiation; and means of applying said high-voltage pulsed electrical current to said ionized channel.

3. The apparatus claimed in claim 2, wherein said means for applying comprises an electrically conductive mirror placed in the path of said ionized channel, said mirror being connected to a first output terminal of said high-voltage pulse-creating electronic circuit.

4. The apparatus claimed in claim 2, wherein said means for applying comprise a plate of electrically conductive, transparent material placed in the path of said beam, said plate being connected to a first output terminal of said high-voltage pulse-creating electronic circuit.

5. The apparatus claimed in claim 2 wherein said beam has a wavelength of 193 nanometers.

6. The apparatus claimed in claim 2 wherein said means for ionizing comprises a laser operated in a pulsed mode.

7. The apparatus claimed in claim 6 which further comprises means for synchronizing said high-voltage pulsed electrical current with said beam of ultraviolet radiation.

8. The apparatus claimed in claim 6 which further comprises means for emitting a second beam of ultraviolet radiation impinging upon said target at a location distant from an impingement point of said first beam and a means for connecting a second output terminal of opposite polarity to said first terminal of said high-voltage pulse-creating electronic circuit to said second beam of ultraviolet radiation.

9. The apparatus claimed in claim 7 which further comprises means for limiting said current to a non-lethal level selected to sustain muscular tetanization in a target subject.

10. The apparatus of claim 8 which further comprises means for limiting said current to a non-lethal level selected to sustain muscular tetanization in a target subject.

11. A method for temporarily immobilizing a human subject which comprises:

stimulating striated, skeletal muscle tissue by the application to part of the subject's body of a series of electrical current impulses, the frequency of said impulses being selected to cause a sustained muscular contraction, wherein said application includes the steps of sequentially;

repetitively ionizing at least one channel of ambient air between a source of high-voltage pulses and said part of the subject's body by emitting a beam of ultraviolet radiation of sufficient energy to cause multi-photon ionization, said beam impinging upon both said source and said part of the subject's body; and discharging said source though said channel.

12. The method claimed in claim 11 wherein, said step of emitting a beam comprises using an ultraviolet source having an energy level sufficient to cause multi-photon ionization through said channel.

13. The method claimed in claim 11, wherein the frequency of said high-voltage impulses is selected between 5 and 2500 hertz.

14. The method claimed in claim 11, wherein the step of emitting a beam comprises using an ultraviolet source having a wavelength of approximately 193 nanometers.

* * * * *

UNITED STATES PATENT AND TRADEMARK OFFICE

CERTIFICATE OF CORRECTION

PATENT NO : 5,675,103

DATED : October 7, 1997

INVENTOR(S) : JAN ERIC HERR

It is certified that error appears in the above-identified patent and that said Letters Patent is hereby corrected as shown below:

In column 2, line 6, replace "445-450" with --745-750--.

In column 2, line 15, replace "1183-1186" with --1883-1886--.

In column 3, line 54, replace "columnated" with --collimated--.

In column 4, line 65, replace "columnated" with --collimated--.

In column 5, line 29, replace "beams 6 and 9" with --beams 6 and 10--.

Signed and Sealed this

Seventeenth Day of March, 1998

*Attest:*

*Attesting Officer*

BRUCE LEHMAN

*Commissioner of Patents and Trademarks*